United States Patent [19]

Petrzelka et al.

[11] Patent Number: 4,724,562

[45] Date of Patent: Feb. 16, 1988

[54] DEVICE FOR CONTROLLING THE POSITION OF A SEMI-PRODUCT OF A TREATED SHOE

[75] Inventors: Antonin Petrzelka, Gottwaldov; Rudolf Pseja, Frystak, both of Czechoslovakia

[73] Assignee: Tovarny Stojirenske Techniky Koncern, Praha, Czechoslovakia

[21] Appl. No.: 849,748

[22] Filed: Apr. 9, 1986

[30] Foreign Application Priority Data

Apr. 9, 1985 [CS] Czechoslovakia ..... 2607-85

[51] Int. Cl.[4] ..... A43D 95/00; C14B 1/44

[52] U.S. Cl. ..... 12/1 R; 12/77; 69/6.5

[58] Field of Search ..... 12/70, 70.5, 17.2, 77, 12/78, 79.3, 1 R; 69/6.5

[56] References Cited

U.S. PATENT DOCUMENTS

| | | | |
|---|---|---|---|
| 441,398 | 11/1890 | Ceperley | 12/79.3 |
| 3,843,985 | 10/1974 | Leonhardt | 12/77 |
| 4,090,378 | 5/1978 | Sommer | 12/1 R |
| 4,324,118 | 4/1982 | Bruggi | 12/1 R |
| 4,561,139 | 12/1985 | Becka et al. | 12/17.2 |

*Primary Examiner*—Steven N. Meyers

[57] ABSTRACT

A device for controlling the position of a semi-product of treated shoes comprises a holder, which is provided with a heel support and a toe cap support, the mutual distance of which is adjustable by means of a displacement chain according to the size of the treated shoe. The holder is arranged in side pieces which are fixed to flanges of a hollow shaft seated in a fork extension piece of a vertical spindle seated on a pin shaft fixed in a supporting platform. A piston rod of a main pressure cylinder is connected to one of the side pieces.

3 Claims, 4 Drawing Figures

DEVICE FOR CONTROLLING THE POSITION OF A SEMI-PRODUCT OF A TREATED SHOE

BACKGROUND OF THE INVENTION

This invention is related to our co-pending applications, Ser. No. 843,980 filed Mar. 25, 1986, entitled Apparatus for Roughening the Margin of Lasted Footwear, and application Ser. No. 849,749, filed simultaneously herewith, entitled Device for Sharpening A Treating Tool.

The invention relates to a device for controlling the position of a semi-product of a treated shoe with respect to the position of a treating tool, consisting of a holder, which is provided with a heel support and toe cap support, the mutual distance of which is adjustable by a displacement chain according to the size of the treated shoe.

There are known devices for treating the circumference of the lower surface of a shoe semi-product, e.g. for making rough a lasting margin of a tightened shoe upper. As to these devices, the holder of the shoe semi-product swings only in two positions. In one position, there is approximately horizontal a heel part and in the other position there is approximately horizontal a toe cap part of the lower surface of the semi-product of the treated shoe, and this is sufficient if shoes with a low heel are treated, i.e. with a relatively small curve of a longitudinal profile of the last. Such an embodiment is applied especially for machines, the holder of which, i.e. the holder of the shoe semi-product moves in combination in a rotary and displacement motion. For making rough a lasting margin of a tightened shoe upper, viz. its side parts, if it concerns shoes with a higher heel, such a known solution is not advantageous, as these parts are of a relative big curves and so considerably great forces of inertia affect the treating head, and this disturbs the determined value of pressure of the treating brush. In this way the side parts of the lasting margin are made rough either too much or too little. As to above mentioned machines, the said holder of which moves in combination of a rotary motion and displacement one, there are known adjustment mechanisms for controlling the length of the displacement motion of the holder according to the size number of the treated she, which comprises a tiltable toe cap stop. A disadvantage of these mechanisms is the necessity to shift away the toe cap stop, and together with it the toe cap support as well, into the initial position before starting each individual working cycle. This disadvantage results in a time loss, especially if it concerns the treatment of shoes with small size numbers.

SUMMARY OF THE INVENTION

It is an object of this invention to provide a device in which the disadvantages of the described devices of the prior art are eliminated or at least mitigated. The principle of the invention resides in the fact that the holder is arranged in side pieces, which are fixed to flanges of a hollow shaft seated in a fork extension piece of a vertical spindle seated on a pin shaft fixed into a supporting platform, and to one of the side pieces there is connected a piston rod of a main pressure cylinder. To the holder there are connected first balanced beams and second balanced beams, which are together seated in the side pieces, on one of which side pieces there is seated a pinion, which pinion is provided with a first chain wheel, which wheel engages a segment gear arranged on a table board fixed to the vertical spindle, and in the hollow shaft there is seated an internal shaft connected to a second chain wheel of which second chain wheel, the first chain wheel is connected by a gearing chain and a cam of the internal shaft is in contact with a roller of a lower lever seated on one of the side pieces and connected to a pull rod, which pull rod is connected to an angle extension piece of one of the first balance beams. To the vertical spindle there is connected a driven gear, which is connected, by means of a gearing to a driving gear of a rotary hydraulic motor seated on the supporting platform. On the holder there is seated an additional chain wheel, which engages a displacement chain of a toe cap support and which additional chain wheel is connected to a multi-position rotary distributor of a pressure medium, the outlet holes of which are individually connected to pressure cylinders, the piston rods of which are arranged in angle pitches of a circle of a distribution body fixed to one of the side pieces coaxially to the internal shaft, onto which internal shaft there is fixed an arm of a control finger, one end of which finger is arranged at the level of the circle of the piston rods of the pressure cylinders and the other end of which finger is in contact with a lever mechanism of a valve of the distribution system of the pressure medium of the main pressure cylinder and rotary hydraulic motor.

The advantage of the present invention resides in the fact that, when treating side parts of the lower surface of a shoe semi-product, the holder of the shoe semi-product swings continuously by a swing of side pieces. The holder of the shoe semi-product swings more over continuously in a correction motion of a four-elbow mechanism acording to a function shape of a cam, which corresponds with curves of a longitudinal profile of the last of the type of shoes being treated. In this way an advantageous position of the semi-product of the shoes is achieved in the course of the whole cycle of the treatment. A rotation motion of the vertical spindle with side pieces and with the holder of the shoe semi-product is simply derived from the rotary hydraulic motor. By a longitudinal adjustment of the toe cap support when clamping the shoe semi-product, there is automatically switched cover a multiposition rotation distributor of the pressure medium for finishing the swing of the side pieces and for starting a rotary motion of the vertical spindle according to the size of the clamped shoe semi-product.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE PREFERRED EMBODIMENT

Figure 1:
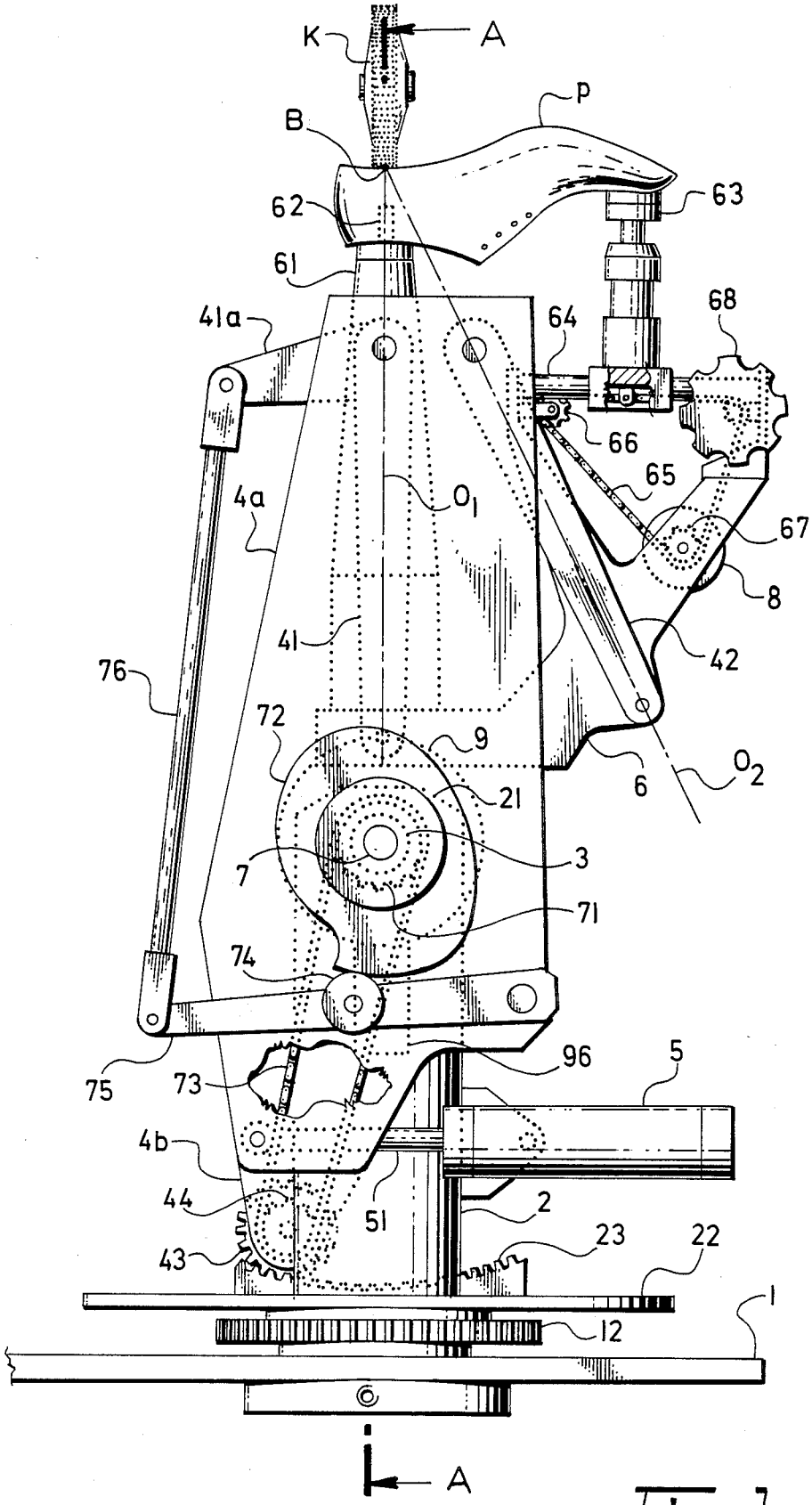
FIG. 1 shows a front elevation in the position of making rough a heel part of the lasting margin of the tightened shoe upper.
Figures 3, 4:
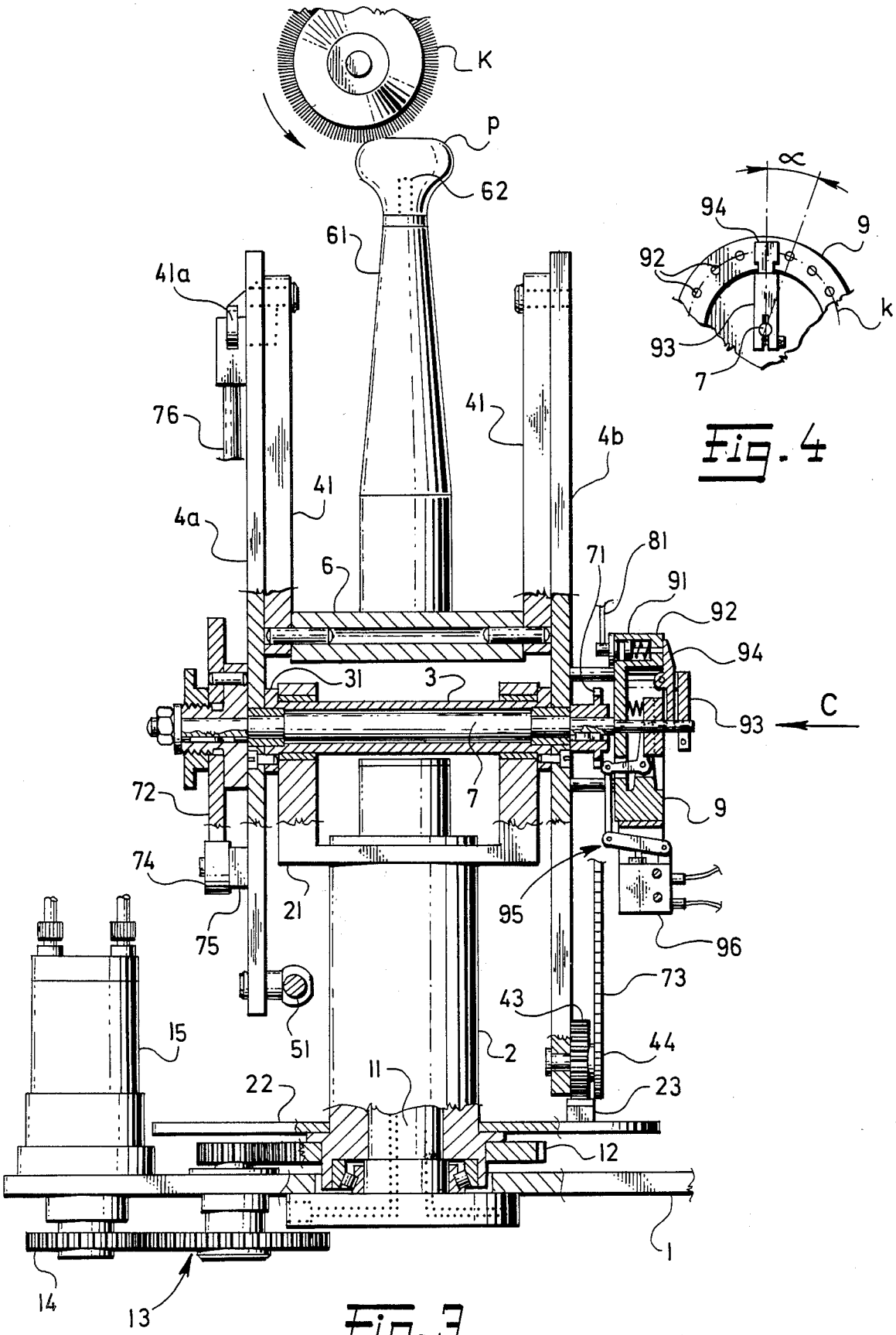
FIG. 3 shows a section in the plane A—A according to FIG. 1.
FIG. 4 shows a view "C" according to FIG. 3.

Referring to FIGS. 1 and 3, on a supporting platform 1, which is arranged on a frame of the machine (not shown), there is fixed a pin shaft 11, on which a vertical spindle 2 is seated. The vertical spindle 2 is provided with a driven gear 12, which is connected by means of a gearing 13 to a driving gear 14 of a rotary hydraulic motor 15. The hydraulic motor 15 is seated on the supporting platform 1. To the upper end of the vertical spindle 2 there is fixed a fork extension piece 21 in which a hollow shaft 3 with flanges 31 is seated. To the flanges 31, side pieces 4*a* and 4*b* are fixed. To one of the side pieces, e.g. 4*a*, there is connected a piston rod 51 of a main pressure cylinder 5. In each side piece 4*a*, 4*b* there are seated a first balance beam 41 with the axis $O_1$ and a second balance beam 42 with the axis $O_2$, which beams are mutually connected to a holder 6 of a semi-product P of the treated shoe. A brush K for roughening the surface of semi-product P lies close to the lasting margin of the tightened shoe upper of the semi-product P of the treated shoe. The brush K is rotatingly seated in a head (not shown).

Refering to FIG. 1, the holder 6 consists of a heel support 61, being fixed by a clamping pin 62 of a last, and of a toe cap support 63. The toe cap support 63 is shiftingly seated on a guide 64, which makes, together with the heel support 61 a rigid whole of the holder 6. The toe cap support 63 is connected to a displacement chain 65, which is seated round guide chain wheels 66 and round an additional chain wheel 67. One of the guide chain wheels 66 is connected to a hand wheel 68. The holder 6 makes a four-joint mechanism together with the first balance beams 41 and second balance beams 42. The said mechanism is swingable round an instantaneous center of rotation B, which lies in the crossing point of axes $O_1$, $O_2$. Compare FIG. 1 and 2.

Referring to FIGS. 1 and 3, in the lower part of the side piece 4*b* there is seated a pinion 43, which is provided with a first chain wheel 44 and it is in engagement with a segment gear 23, which is seated on a table board 22 fixed to the vertical spindle 2. In the hollow shaft 3 there is seated an internal shaft 7, on one end of which a second chain wheel 71 is keyed on, and on the other end there is keyed on a cam 72. The second chain wheel 71 is connected to the first chain wheel 44 of the pinion 43 by means of a gearing chain 73. A roller 74 of a lower lever 75 is in contact with a function shape of the cam 72. The said lower lever 75 is seated on the side piece 4*a* and it is connected to a pull rod 76, which is joined to an angle extension piece 41*a* of one of the first balance beams 41. To the additional chain wheel 67 for the displacement of the toe cap support 63, there is fixed a known multiposition rotation distributor 8 of a pressure medium, the outlet holes of which are individually connected by means of pipes 81 to pressure cylinders 91 with piston rods 92. Referring to FIGS. 3 and 4, the pressure cylinders 91 with piston rods 92 are arranged in angle pitches [alpha] of a circle k of a distribution body 9, which is fixed to the side piece 4*b* coaxially to the internal shaft 7. On the internal shaft 7 there is fixed an arm 93 of a control finger 94. One end of the control finger 94 is arranged at the level of the circle k of the piston rods 92 of the pressure cylinders 91, and the other end is in contact with a lever mechanism 95 of a valve 96, which is arranged in the distribution system of the pressure medium of the main pressure cylinder 5 and rotary hydraulic motor 15.

The present invention operates as follows: The operator of the machine clamps a shoe semi-product P to the heel support 61 and to the toe cap support 63 of the holder 6. The toe cap support 63 is shifted, by turning the hand wheel 68, such a distance from the heel support 61, which corresponds with the size number of the clamped semi-product P of the shoe. When turning the hand wheel 68, the additional chain wheel 67 also turns because of the function of the displacement chain 65 and with it also the multiposition rotation distributor 8 of the pressure medium. When finishing the displacement of the toe cap support 63 on the guide 64 of the holder 6, the outlet hole of the multiposition rotation distributor 8 of the pressure medium, which is designed for the size number of the clamped shoe semi-product P, is automatically interconnected by pipe 81 to the respective pressure cylinder 91 of the distribution body 9. The operator of the machine then starts, by means of a controller (not shown), the automatic working cycle of the machine. The rotating brush K for making the surface rough approaches to the semi-product P of the treated shoe and bears on its lasting margin of the tightened shoe upper in the spot of the boundary of its side and heel part. At the same moment the vertical spindle 2 with side pieces 4*a*, 4*b* and with the holder 6 of the semi-product P of the treated shoe starts turning by means of the rotary hydraulic motor 15. In this way, the vertical spindle 2 turns through 180° and the brush K for making the surface rough makes rough the whole heel part of the lasting margin of the tightened shoe upper. Immediately after this rotating motion has been finished, the piston rod 51 of the main pressure cylinder 5 starts pushing in, and in this way the side pieces 4*a*, 4*b* start swinging with the hollow shaft 3 in the fork extension piece 21 of the vertical spindle 2. At this swinging motion of the side pieces 4*a*, 4*b*, the pinion 43 rolls on the segment gear 23 and so the first chain wheel 44 starts to turn the second chain wheel 71 and with it the internal shaft 7 by means of the transmission chain 73. As shaft 7 turns, so does the cam 72 which makes swinging the lower lever 75 through the roller 74, and in this way the pull rod 76 makes swinging the angle extension piece 41a of the first balance beam 41. In this way, there swings in side pieces 4*a*, 4*b* the whole four-joint mechanism of the holder 6.

Figure 2:
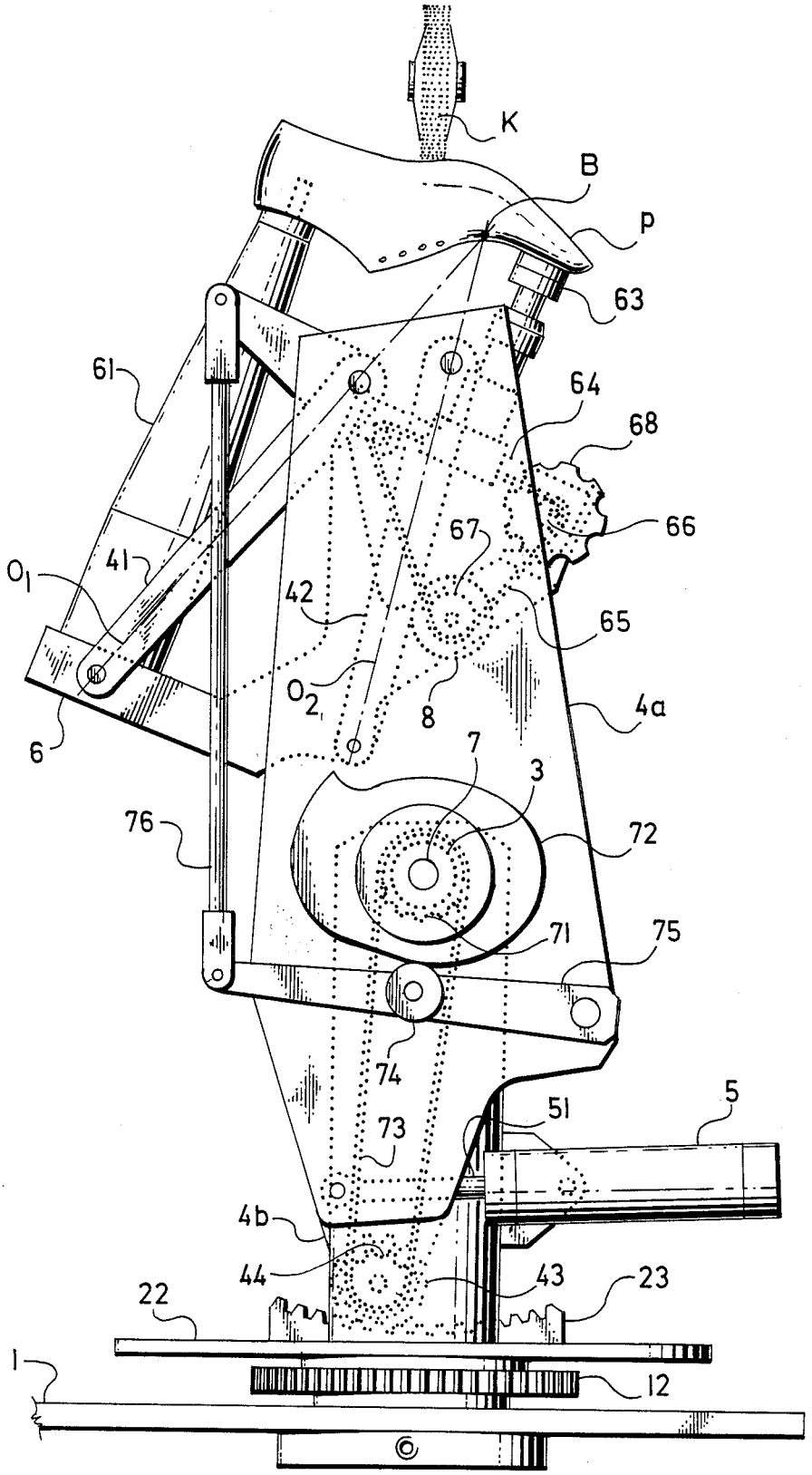
FIG. 2 shows the same front elevation in the position of making rough a side part of the lasting margin of the tightened shoe upper.

The resulting movement of the holder 6 with the shoe semi-product P during making rough the side part of the lasting margin of the tightened shoe upper is a result of the swinging movement of the side pieces 4*a*, 4*b* on the hollow shaft 3 and of the swinging movement of the four-joint mechanism around its instantaneous center B of rotation. FIG. 2 shows the device in the course of these two movements, i.e. during making rough the side part of the lasting margin of the tightened shoe upper. So the brush K is permanently in an advantageous perpendicular position with respect to the contour curve of the lower longitudinal profile of the treated shoe semi-product P. In this way undersired inertia forces of the brush head are distinguished in a considerable way, and the uniformity of the press of the brush K is increased and in this way the quality of the roughening of the lasting margin of the tightened shoe surface is also increased.

By turning the internal shaft 7, the arm 93 with the control finger 94 is also turned. As soon as the control finger 94 turns into the position of the piston rod 92 of the pressure cylinder 91, which was interconnected by the rotation distributor 8 of the pressure medium in course of clamping the shoe semi-product, the pressure medium shifts out the said piston rod. In this way, the control finger 94 leans out and by a contact with the lever mechanism 95 it shifts over the valve 96 into a position in which the function of the main pressure cylinder is finished and simultaneously there starts the reverse rotation of the rotary hydraulic motor 15. In this way, the vertical spindle 2 turns back through 180° and during this turning the toe cap part of the lasting margin of the tightened shoe upper is made rough. Then a reverse swinging movement of the side pieces 4*a*, 4*b* follows, viz. in combination with the swinging movement of the four-joint mechanism of the holder 6, and in this way the remaining side part of the lasting margin is made rough. This operation finishes the operational cycle of the machine.

The invention may be applied when designing a machine for treating the lower part of a shoe semi-product, especially for making rough a tightened shoe upper.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A device for controlling the position of a semi-product of a treated shoe with respect to the position of a treating tool, comprising a holder, which holder is provided with a heel support and a toe cap support, the mutual distance of which is adjustable by a displacement chain according to the size of the treated shoe, the holder being seated in two side pieces, which are fixed to flanges of a hollow shaft seated in a fork extension piece of a vertical spindle seated on a pin shaft fixed into a supporting platform, and to one of the side pieces there is connected a piston rod of a main pressure cylinder, whereby the semi-product of the treated shoe is mounted on said holder by adjustment of said toe cap and heel supports and the position of said holder is controlled by turning of said vertical spindle on said pin shaft which action turns said side pieces and thereby turns said holder, the position of said holder being further controlled by said piston rod which, when activated by said pressure cylinder, tilts said said said pieces about said hollow shaft in said fork extension.

2. A device according to claim 1, wherein the holder is seated in the side pieces by first balance beams and second balance beams, which beams are together seated in the side pieces, on one of which side pieces there is seated a pinion, which pinion is provided with a first chain wheel and which pinion engages a segment gear arranged on a table board fixed to the vertical spindle, and in the hollow shaft there is seated an internal shaft, which internal shaft is connected at one end to a second chain wheel of which the first chain wheel is connected by a gearing chain, the other end of said internal shaft being connected to a cam, which cam is in contact with a roller of a lower lever, which lower lever is seated on one of the side pieces and connected to a pull rod, which pull rod is connected to an angle extension piece of one of the first balance beams, whereby the swinging motion of the side pieces causes said pinion to roll on said segment gear and thereby the first chain wheel to turn the second chain wheel and with it the internal shaft by means of the gearing chain, which results in turning of the cam which swings the lower lever through the roller, and in this way the pull rod swings the angle extension piece of the first balance beam.

3. A device according to claim 1, wherein the vertical spindle is connected to a driven gear, which driven gear is connected, by means of a gearing, to a driving gear of a rotary hydraulic motor, said motor being seated on the supporting platform.

* * * * *